US012421690B2

(12) United States Patent
DeWind et al.

(10) Patent No.: US 12,421,690 B2
(45) Date of Patent: Sep. 23, 2025

(54) TRENCHER WITH A DETACHABLE DIGGING BOX

(71) Applicant: One Pass Innovators, LLC, Zeeland, MI (US)

(72) Inventors: Ryan DeWind, Zeeland, MI (US); Gregory Allen DeWind, Zeeland, MI (US)

(73) Assignee: One Pass Innovators, LLC, Zeeland, MI (US)

( * ) Notice: Subject to any disclaimer, the term of this patent is extended or adjusted under 35 U.S.C. 154(b) by 946 days.

(21) Appl. No.: 17/558,557

(22) Filed: Dec. 21, 2021

(65) Prior Publication Data

US 2022/0195695 A1 Jun. 23, 2022

Related U.S. Application Data

(60) Provisional application No. 63/128,673, filed on Dec. 21, 2020.

(51) Int. Cl.

| | |
|---|---|
| ***E02F 5/06*** | (2006.01) |
| ***E02F 3/08*** | (2006.01) |
| ***E02F 3/14*** | (2006.01) |
| ***E02F 5/14*** | (2006.01) |

(52) U.S. Cl.

CPC ..... *E02F 5/06* (2013.01); *E02F 3/088* (2013.01); *E02F 3/145* (2013.01); *E02F 5/14* (2013.01)

(58) Field of Classification Search

CPC ..... E02F 5/14; E02F 5/06; E02F 5/109; E02F 3/14; E02F 3/145; E02F 3/146; E02F 3/088; E02F 3/3609

See application file for complete search history.

(56) References Cited

U.S. PATENT DOCUMENTS

| | | | | |
|---|---|---|---|---|
| 2,790,255 A * | 4/1957 | Riley | ..... | E02F 3/08 37/360 |
| 3,178,838 A * | 4/1965 | Brown | ..... | B62D 51/04 180/6.54 |
| 3,398,471 A * | 8/1968 | Brown | ..... | E02F 3/10 37/352 |
| 4,159,630 A * | 7/1979 | Schuermann | ..... | E02F 5/145 405/174 |

(Continued)

*Primary Examiner* — Christopher J Sebesta
*Assistant Examiner* — Audrey L Lusk
(74) *Attorney, Agent, or Firm* — The Watson IP Group; Jovan N. Jovanovic

(57) ABSTRACT

A trencher includes a drive mechanism, a detachable digging box, and a digging support member. The detachable digging box receives power from an intermediate drive member transferring power from the drive mechanism to a trenching chain coupled to the detachable digging box. The drive mechanism and the detachable digging box are coupled to the intermediate drive member. The digging box support member includes a first end and a second end. The digging box support member is pivotably coupled to the detachable digging box at the first end of the digging box support member via a detachable coupler and pivotably coupled to a frame of the trencher at the second end of the digging box support member. The detachable digging box is detachable from the digging box support member via the detachable coupler without decoupling the intermediate drive member from the trencher.

12 Claims, 5 Drawing Sheets

(56) References Cited

U.S. PATENT DOCUMENTS 4,195,427 A * 4/1980 Lanham ..... E02F 3/10
37/362
4,660,306 A * 4/1987 Bruce ..... E02F 3/10
37/363

* cited by examiner

TRENCHER WITH A DETACHABLE DIGGING BOX

CROSS-REFERENCE TO RELATED APPLICATION

This application claims priority from U.S. Provisional Patent Application Ser. No. 63/128,673 filed on Dec. 21, 2020, entitled "TRENCHER WITH A DETACHABLE DIGGING BOX", the entire disclosure of which is hereby incorporated by reference in its entirety.

BACKGROUND OF THE DISCLOSURE

1. Field of the Disclosure

The disclosure relates in general to a trencher, and more particularly, to a trencher with a detachable digging box.

2. Background Art

In-ground systems are used for a variety of purposes, such in-ground systems include in-ground trenches and walls. These in-ground systems can include ground fluid and product recovery trenches, seepage trenches/collection trenches, slurry walls and cement walls, permeable reactive barriers/full and gate systems, High Density Poly Ethylene (HDPE) barrier walls, underground alluvial fluid storage reservoir containment walls, cement footing foundations and "formless walls", etc. Large scale industrial trenchers have been developed that are able to dig trenches that are extremely deep (e.g., 125' feet or more below grade), these trenches being used to form such in-ground trenches and walls.

SUMMARY OF THE DISCLOSURE

The disclosure is directed to trencher comprising a drive mechanism, a detachable digging box, and a digging support member. The drive mechanism powers a trenching chain to dig a trench. The detachable digging box receives power from an intermediate drive member transferring power from the drive mechanism to the trenching chain coupled to the detachable digging box. The intermediate drive member includes a first end and a second end, the drive mechanism being coupled to the intermediate drive member proximate to the first end of the intermediate drive member, and the detachable digging box being coupled to the intermediate drive member proximate to the second end of the intermediate drive member. The digging box support member includes a first end and a second end. The digging box support member is pivotably coupled to the detachable digging box at the first end of the digging box support member via a detachable coupler and pivotably coupled to a frame of the trencher at the second end of the digging box support member. The detachable digging box is detachable from the digging box support member via the detachable coupler without decoupling the intermediate drive member from the trencher.

In at least one configuration, the detachable coupler includes a first "C" shaped member disposed over a shaft fixedly coupled to the detachable digging box, and a second "C" shaped member disposed over the shaft, the first and second "C" shaped members allowing the detachable digging box to pivot about the shaft relative to the intermediate drive member.

In at least one configuration, each of the first and second "C" shaped members include a first end and a second end, the first and second "C" shaped members further include coupling plates fixedly coupled to the first and second ends of the first and second "C" shaped members, respectively, the coupling plates including holes to accept bolts therethrough, the bolts coupling the coupling plates to the first end of the digging box support member.

In at least one configuration, the coupling plates further include side members fixedly coupled to the coupling plates, the side members being substantially orthogonally coupled to the coupling plates.

In at least one configuration, the coupling plates further include hinge members to pivotally support the first and second "C" shaped members while the first and second "C" shaped members are not coupled to the detachable digging box.

In at least one configuration, the coupling plates are substantially square.

In at least one configuration, the intermediate drive member is a first intermediate drive member, the trencher including a second intermediate drive member including a first end and a second end, the first end of the second intermediate drive member being coupled to the drive mechanism and the second end of the second intermediate drive member being coupled to the first end of the first intermediate drive member, the second intermediate drive member transferring power from the drive mechanism to the first intermediate drive member.

In at least one configuration, the intermediate drive member is a first intermediate drive member, the trencher including a second intermediate drive member including a first end and a second end, the first end of the second intermediate drive member being coupled to the second end of the first intermediate drive member and the second end of the second intermediate drive member being coupled to the detachable digging box, the second intermediate drive member transferring power from the first intermediate drive member to the detachable digging box.

In at least one configuration, the trencher further includes first and second hydraulic actuators to pivot the detachable digging box about the detachable coupler.

In at least one configuration, the detachable digging box includes a shaft and a gear fixedly coupled to the shaft, the drive mechanism powering the shaft via the intermediate drive member to rotate the gear to drive the trenching chain.

In at least one configuration, the drive mechanism is an engine.

In at least one configuration, the engine is a Caterpillar C32 engine.

In at least one configuration, the digging box support member includes hinge members, disposed at the second end of the digging box support member, to allow the digging box support member to pivotably couple to the frame of the trencher at the second end of the digging box support member.

BRIEF DESCRIPTION OF THE DRAWINGS

The disclosure will now be described with reference to the drawings wherein.

DETAILED DESCRIPTION OF THE DISCLOSURE

Figure 1:
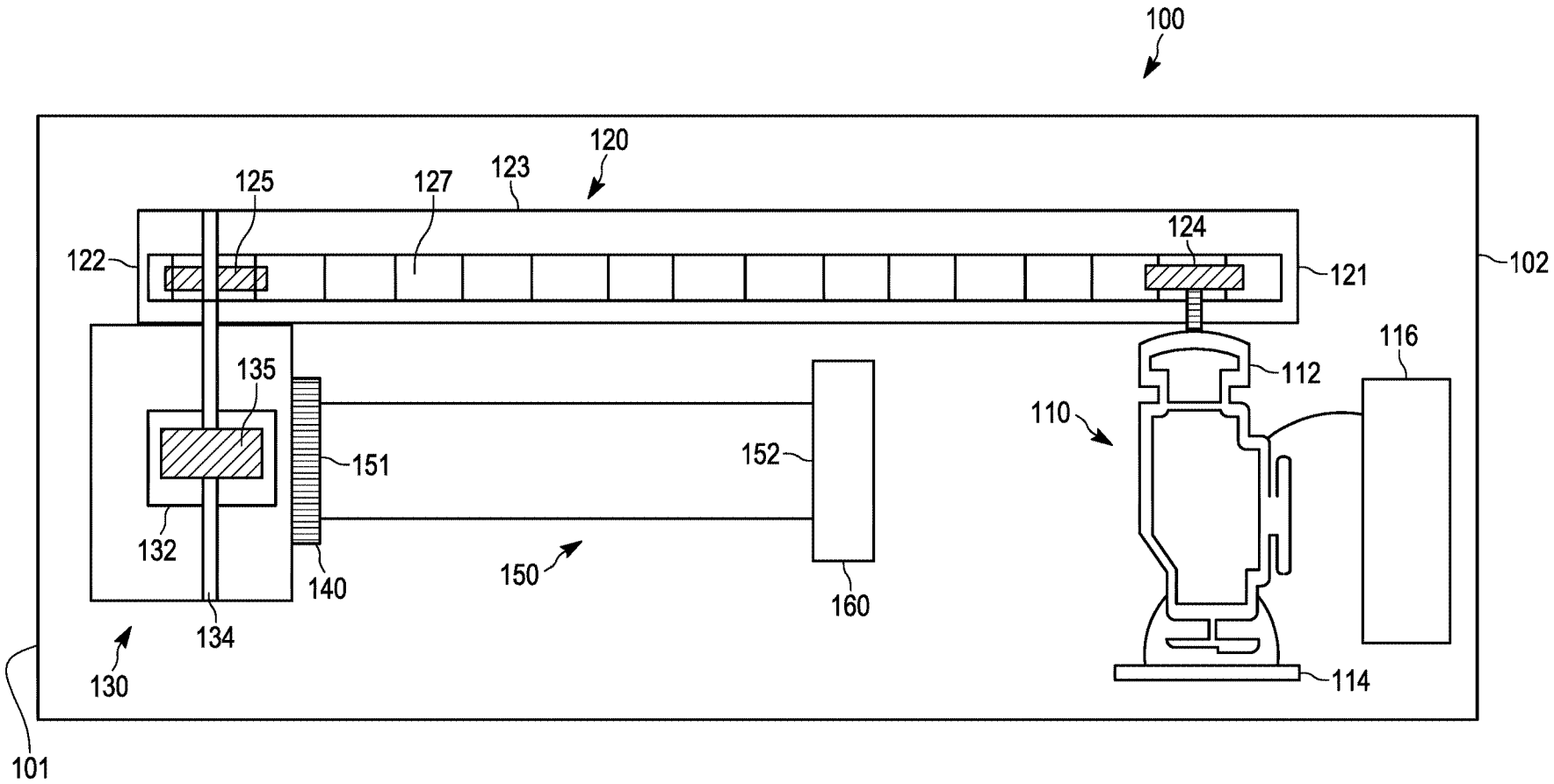
FIG. 1 illustrates a schematic diagram of an example trencher including a detachable a detachable digging box, in accordance with at least one configuration disclosed.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Different job sites can utilize different sized trenching chains and even multiple trenching chains, each utilizing different size digging boxes. As a rest of the trencher being able to utilize multiple sizes of digging boxes, substantially only the digging box and digging chain are switched out to accommodate particular needs of a particular job site. Typical trenchers require substantial disassembly and reassembly to switch from one size digging box to another size digging box. An example detachable digging box and a detachable coupler, described in detail below, reduces an amount of disassembly and reassembly to switch between different size digging boxes. Such reduced disassembly and assembly save substantial time and labor to switch between such different size digging boxes.

Referring now to the drawings, and in particular to FIG. 1, an apparatus is disclosed herein, such as a trencher 100. The trencher 100 includes a drive mechanism 110. In at least one configuration, the drive mechanism 110 is an engine 410 (FIG. 4), such as a Caterpillar C32 engine. Such an engine can be coupled to a transmission 112, a fuel tank 116, and a radiator 114. The transmission 112 can use a reduction gearset within to increase torque produced by the engine 410. In alternate configurations, the drive mechanism 110 can be a motor (not shown), powered by a battery (not shown). In still other configurations, the drive mechanism 110 can be a hybrid drive mechanism including both the engine and the motor.

Figure 5:
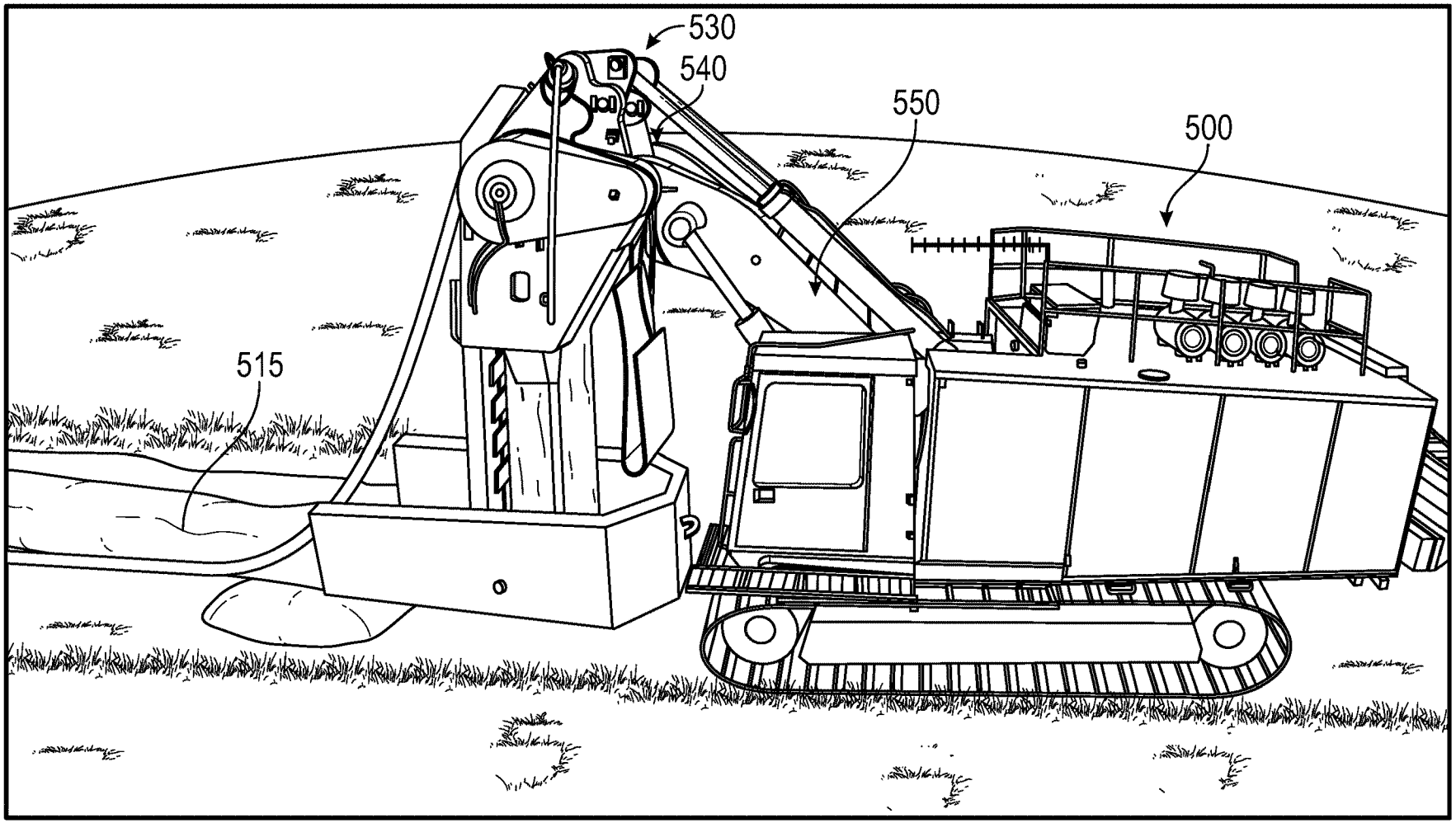
FIG. 5 illustrates a side view of yet another example trencher including a detachable a detachable digging box, this trencher shown digging a trench, in accordance with at least one configuration disclosed.

Irrespective of which type of the drive mechanism 110 being used with the trencher 100, the drive mechanism 110 is used to power a trenching chain 132 to dig a trench, such as that shown in FIG. 5 showing a trench 515 being dug by a trencher 500 that includes a detachable digging box 530 and a detachable coupler 540, such that the detachable digging box 530 is detachable from a digging box support member 550 via the detachable coupler 540. The trencher 100 includes a front end 101 and a back end 102. In at least one configuration, the drive mechanism 110 is disposed proximate to the back end 102 of the trencher 100.

The trencher 100 further includes a detachable digging box 130 to receive power from an intermediate drive member 120 that transfers power from the drive mechanism 110 to the detachable digging box 130. The detachable digging box 130 is detachably coupled to the second end 122 of the intermediate drive member 120, the detachable digging box 130 receiving power from the drive mechanism 110 to drive the trenching chain 132 coupled to the digging box 130. In at least one configuration, the digging box 130 includes a shaft 134 onto which at least one gear is fixedly attached (e.g., welded), such as a gear 135. The gear 135 turns in unison with the shaft 134, with the trenching chain 132 wrapping around the gear 135 and being driven by the gear 135. The drive mechanism 110 powers the shaft 134 via the intermediate drive member 120 to rotate the gear 135 to drive the trenching chain 132.

A digging box support member 150 is included with the trencher 100. The digging box support member 150 includes a first end 151 and a second end 152. The digging box support member 150 is pivotably coupled to the detachable digging box 130 at the first end 151 of the digging box support member 150 via a detachable coupler 140. The digging box support member 150 is pivotably coupled to a frame 160 of the trencher 100 at the second end 152 of the digging box support member 150. In at least one configuration, a digging box support member 250 (FIG. 2) includes hinge members 275 disposed at a second end 252 of the digging box support member 250, the hinge members 275 allowing the digging box support member 250 to pivot about a frame of a trencher.

Figure 2:
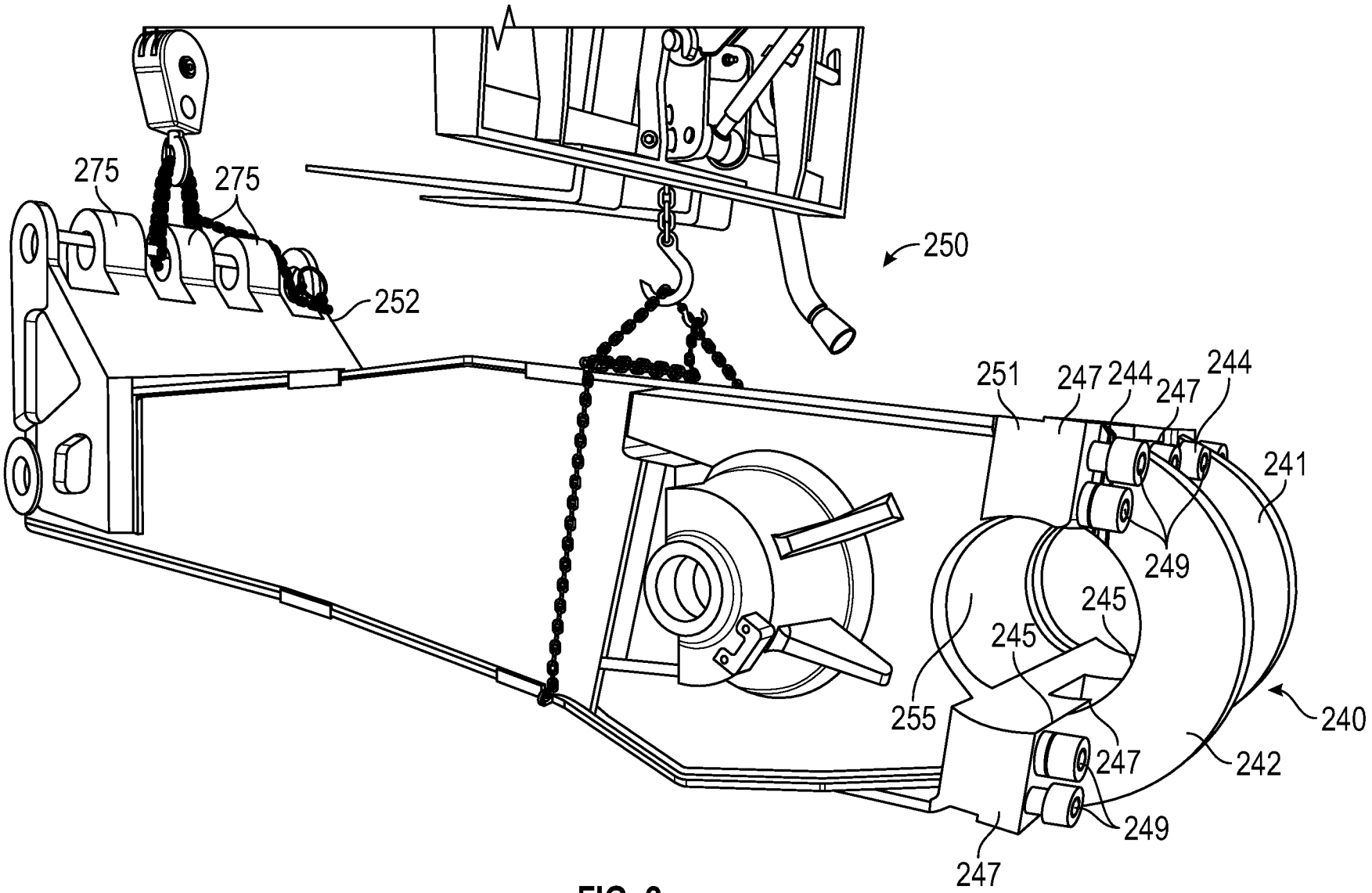
FIG. 2 illustrates an isometric view of an example digging box support member, in accordance with at least one configuration disclosed.
Figure 3:
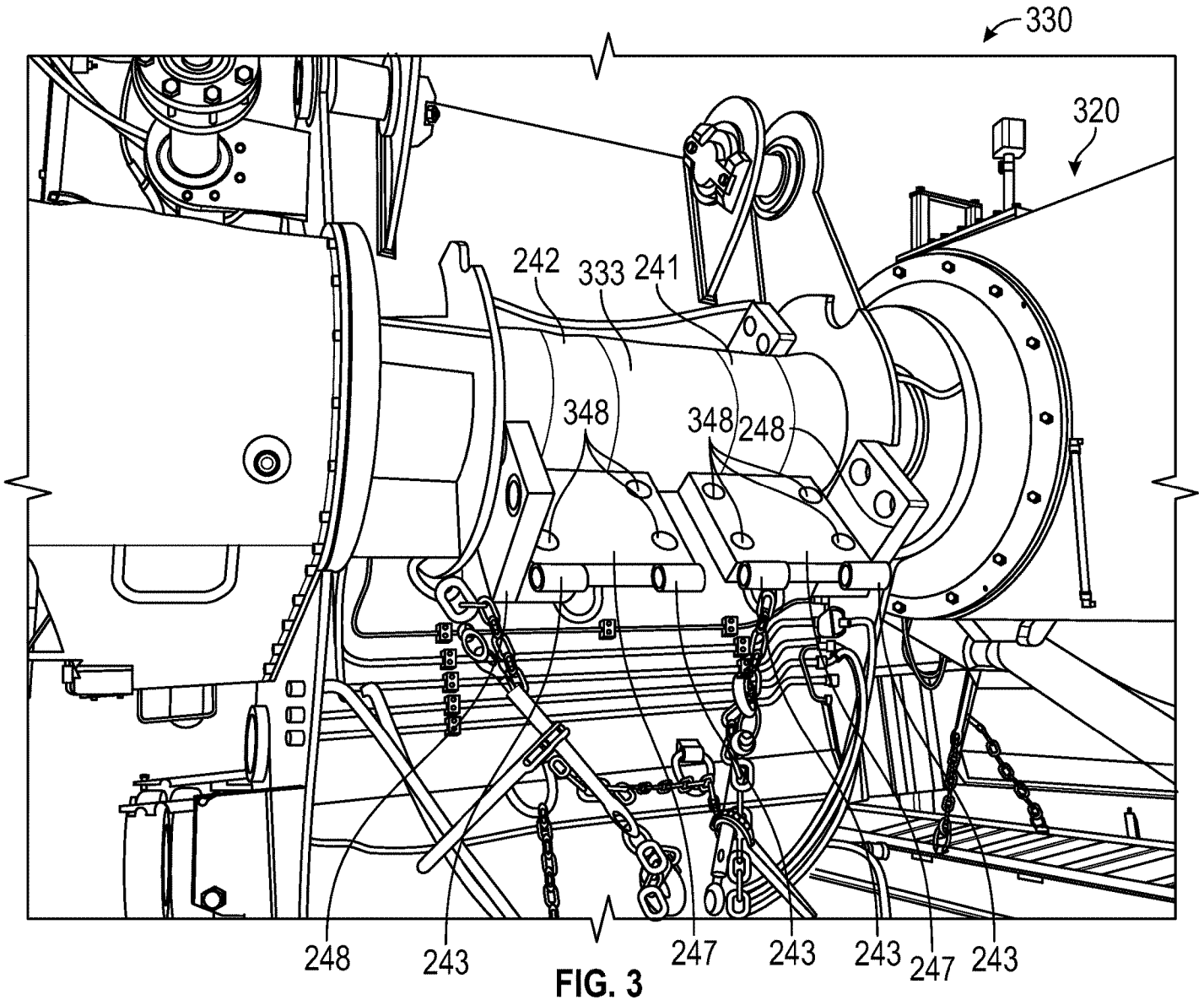
FIG. 3 illustrates an isometric view of an example detachable coupler, in accordance with at least one configuration disclosed.

With reference to FIGS. 2 and 3, an example support member is shown, referenced as the digging box support member 250. A detachable coupler 240 is shown as being coupled to a first end 251 of the digging box support member 250, an opposite end from the second end 252 of the digging box support member 250. In this example, the detachable coupler 240 includes two "C" shaped members, a first "C" shaped member 241 and a second "C" shaped member 242. Although in other configurations, more than two or even one "C" shaped members can be utilized. As shown, the digging box support member 250 includes a half-circle indent 255 at the first end 251 to allow the digging box support member 250. The half-circle indent 255 and the first and second "C" shaped members 241, 242 together form a circular opening 255 through which the digging box support member 250 is coupled to a circular shaft fixedly coupled (e.g., welded) to a detachable digging box, shown in FIG. 3 as shaft 333.

During use, the first and second "C" shaped members 241, 242 are disposed over the shaft 333, the first and second "C" shaped members 241, 242 pivoting about the shaft 333 to allow the detachable digging box 330 to pivot about the shaft 333 relative to the intermediate drive member 320, as shown in FIG. 3. Each of the first and second "C" shaped members 241, 242 include a first end 244 and a second end 245. In at least one configuration, the first and second "C" shaped members 241, 242 further include coupling plates 247 (also shown in FIG. 3) fixedly coupled (e.g., welded) to the first and second ends 244, 245 of the first and second "C" shaped members 241, 242, respectively. In at least one configuration, the coupling plates 247 include holes 348 (FIG. 3) to accept fasteners, such as bolts 249 therethrough, the bolts 249 coupling the coupling plates 247 to the first end 251 of the digging box support member 250.

In at least one configuration, the coupling plates 247 further include side members 248 (FIG. 3) fixedly coupled (e.g., welded) to the coupling plates 247. The side members 248 are substantially orthogonally coupled to the coupling plates 247. In at least one configuration, the coupling plates 247 further include hinge members 243. The hinge members 243 are used to pivotally support the first and second "C"

shaped members 241, 242 while the first and second "C" shaped members 241, 242 are not coupled to the detachable digging box 130. In at least one configuration, the coupling plates 247 are substantially square in shape, as shown. In other configurations, the coupling plates 247 can be other shapes, such as rectangular, circular, oval, or another other shape that allows the first and second "C" shaped members 241, 242 to be coupled to the digging box support member 150.

Back to referencing FIG. 1, the trencher 100 further includes the intermediate drive member 120 to transfer power from the drive mechanism 110 to a detachable digging box 130. In the configuration shown, the intermediate drive member 120 is elongated to space apart the drive mechanism 110 from the detachable digging box 130. In at least one configuration, the intermediate drive member 120 includes gears and a chain within a housing 123 of the intermediate drive member 120, to transfer power from one end thereof to another. The intermediate drive member 120 includes a first end 121 and a second end 122, the drive mechanism 110 being coupled to the intermediate drive member 120 proximate to the first end 121 of the intermediate drive member 120 and the detachable digging box 130 being coupled to the intermediate drive member 120 proximate to the second end 122 of the intermediate drive member 120.

In at least one configuration, disposed proximate to the first end 121 of the intermediate drive member 120 is a first gear 124 and disposed proximate to the second end 122 is a second gear 125. A chain 127 wraps around the first gear 124 and the second gear 125 to transfer power received by the first gear 124 from the drive mechanism 110 to the detachable digging box 130 via the second gear 125. A length of the intermediate drive member 120 can vary depending upon a size of the trencher 100, with some examples of the intermediate drive member 120 being over a hundred (100) feet long (FIG. 4) to reach the detachable digging box 130. The shaft 134 of the digging box 130 couples the second gear 125 of the intermediate drive member 125 to the gear 135 of the detachable digging box 130, to transfer power from the intermediate drive member 125 to the detachable digging box 130. To reduce an amount of time and labor for switching the detachable digging box 130 for another size detachable digging box (not shown), the detachable digging box 130 is detachable from the digging box support member 150 without having to decouple the intermediate drive member 125 from the trencher 100.

Figure 4:
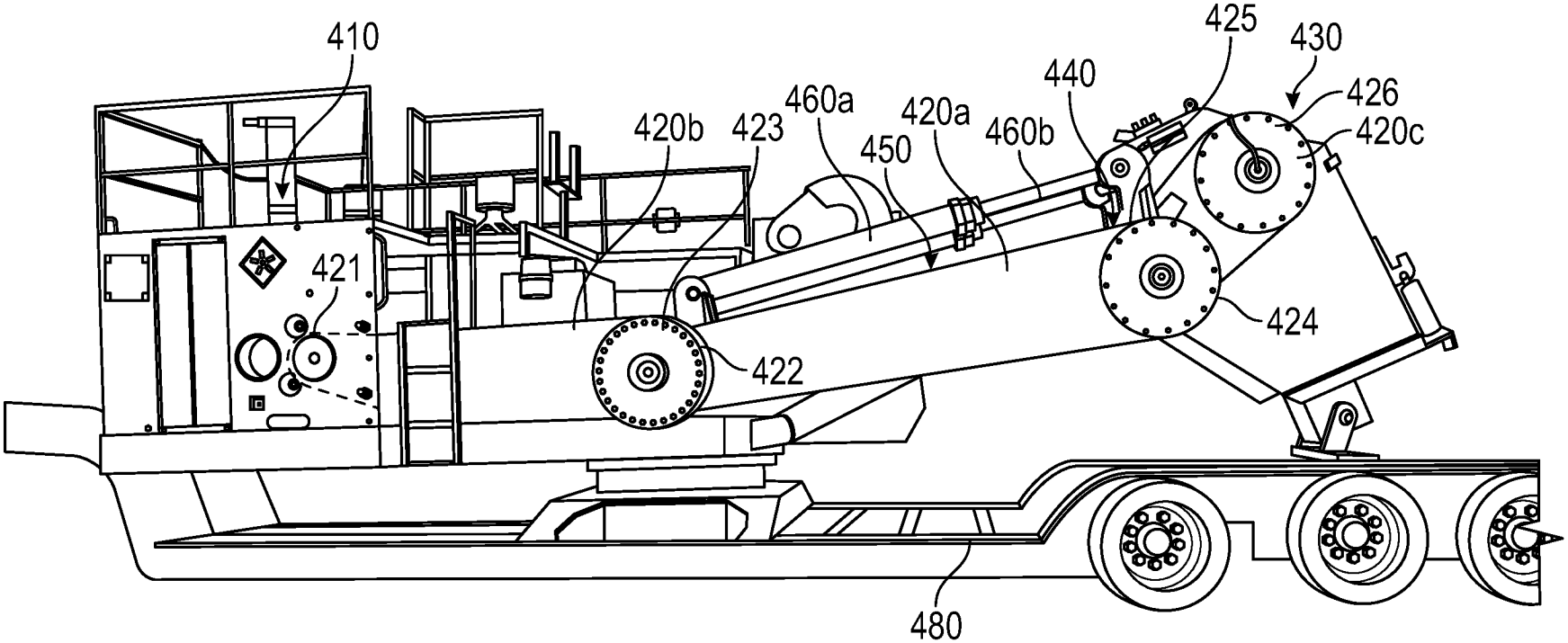
FIG. 4 illustrates a side view of another example trencher, in accordance with at least one configuration disclosed.

With reference to FIG. 4, a trencher 400 is shown disposed upon a transport trailer 480 for transport either to or from a worksite, the trencher 400 shown without a trenching chain being attached to a detachable digging box 430, but shown with the detachable digging box 430 being coupled to a digging box support member 450. In at least one configuration, the trencher 400 includes more than one intermediate drive member, such as a first intermediate drive member 420*a* and a second intermediate drive member 420*b*. The second intermediate drive member 420*b* includes a first end 421 and a second end 422. A drive mechanism 410 is coupled proximate to the first end 421 of the second intermediate drive member 420*b* and the second end 422 of the second intermediate drive member 420*b* being coupled proximate to the first end 423 of the first intermediate drive member 420*b*. The second intermediate drive member 420*b* transfers power from the drive mechanism 410 to the first intermediate drive member 420*a*.

In at least one configuration, the trencher 400 includes a third intermediate drive member, such as a third intermediate drive member 420*c* including a first end 425 and a second end 426. The first end 425 of the third intermediate drive member 420*c* is coupled to the second end 424 of the first intermediate drive member 420*a* and the second end 426 of the third intermediate drive member 420*c* is coupled to the detachable digging box 430. The third intermediate drive member 420*c* transfers power from the first intermediate drive member 420 to the detachable digging box 430. Also shown in FIG. 4, in at least one configuration the trencher 400 further includes first and second hydraulic actuators 460*a*, 460*b* that pivot the detachable digging box 430 about the detachable coupler 440, although more or even a single hydraulic actuator is possible.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A trencher, comprising:

a drive mechanism to power a trenching chain to dig a trench;

a detachable digging box to receive power from an intermediate drive member transferring power from the drive mechanism to the trenching chain coupled to the detachable digging box, the intermediate drive member including a first end and a second end, the drive mechanism being coupled to the intermediate drive member proximate to the first end of the intermediate drive member, and the detachable digging box being coupled to the intermediate drive member proximate to the second end of the intermediate drive member; and a digging box support member including a first end and a second end, the digging box support member being pivotably coupled to the detachable digging box at the first end of the digging box support member via a detachable coupler and pivotably coupled to a frame of the trencher at the second end of the digging box support member;

wherein the detachable coupler includes a first "C" shaped member disposed over a shaft fixedly coupled to the detachable digging box and a second "C" shaped member disposed over the shaft, the first and second "C" shaped members allowing the detachable digging box to pivot about the shaft relative to the intermediate drive member; and wherein the detachable digging box is detachable from the digging box support member without decoupling the intermediate drive member from the trencher.

2. The trencher according to claim 1, wherein each of the first and second "C" shaped members include a first end and a second end, the first and second "C" shaped members further include coupling plates fixedly coupled to the first and second ends of the first and second "C" shaped members, respectively, the coupling plates including holes to accept bolts therethrough, the bolts coupling the coupling plates to the first end of the digging box support member.

3. The trencher according to claim 2, wherein the coupling plates further include side members fixedly coupled to the coupling plates, the side members being substantially orthogonally coupled to the coupling plates.

4. The trencher according to claim 2, wherein the coupling plates further include hinge members to pivotally support the first and second "C" shaped members while the first and second "C" shaped members are not coupled to the detachable digging box.

5. The trencher according to claim 2, wherein the coupling plates are substantially square.

6. The trencher according to claim 1, wherein the intermediate drive member is a first intermediate drive member, the trencher including a second intermediate drive member including a first end and a second end, the first end of the second intermediate drive member being coupled to the drive mechanism and the second end of the second intermediate drive member being coupled to the first end of the first intermediate drive member, the second intermediate drive member transferring power from the drive mechanism to the first intermediate drive member.

7. The trencher according to claim 1, wherein the intermediate drive member is a first intermediate drive member, the trencher including a second intermediate drive member including a first end and a second end, the first end of the second intermediate drive member being coupled to the second end of the first intermediate drive member and the second end of the second intermediate drive member being coupled to the detachable digging box, the second intermediate drive member transferring power from the first intermediate drive member to the detachable digging box.

8. The trencher according to claim 1, wherein the trencher further includes first and second hydraulic actuators to pivot the detachable digging box about the detachable coupler.

9. The trencher according to claim 1, wherein the detachable digging box includes a shaft and a gear fixedly coupled to the shaft, the drive mechanism powering the shaft via the intermediate drive member to rotate the gear to drive the trenching chain.

10. The trencher according to claim 1, wherein the drive mechanism is an engine.

11. The trencher according to claim 10, wherein the engine is a Caterpillar C32 engine.

12. The trencher according to claim 1, wherein the digging box support member includes hinge members, disposed at the second end of the digging box support member, to allow the digging box support member to pivotably couple to the frame of the trencher at the second end of the digging box support member.

* * * * *